United States Patent [19]

Hirose

[11] Patent Number: 4,750,713

[45] Date of Patent: Jun. 14, 1988

[54] ASSEMBLY OF HANDRAIL

[75] Inventor: Norio Hirose, Fuwa, Japan

[73] Assignee: Sunrail Co., Ltd., Gifu, Japan

[21] Appl. No.: 34,383

[22] Filed: Apr. 2, 1987

[51] Int. Cl.[4] ..... E04H 17/14

[52] U.S. Cl. ..... 256/69; 256/55

[58] Field of Search ..... 256/65, 69, 55

[56] References Cited

U.S. PATENT DOCUMENTS

| | | | |
|---|---|---|---|
| 3,596,880 | 8/1971 | Greenberg | 256/65 |
| 3,918,686 | 11/1975 | Knott et al. | 256/65 X |
| 4,586,697 | 5/1986 | Tornya | 256/65 |

FOREIGN PATENT DOCUMENTS

| | | | |
|---|---|---|---|
| 1475039 | 2/1967 | France | 256/65 |

*Primary Examiner*—Andrew V. Kundrat

*Attorney, Agent, or Firm*—Koda and Androlia

[57] ABSTRACT

An assembly of handrail comprises vertical members and horizontal members made up dividably of an upper body and a lower body. Either of these bodies is provided at required locations with openings for the insertion of the end part of the vertical member, while is provided inside with a horizontal supporting wall. The end part of the vertical member passed through the opening is brought into contact with the horizontal supporting member while a screw member is tightened through the horizontal supporting wall into the vertical member so that the connection between the vertical and horizontal members is performed.

5 Claims, 9 Drawing Sheets

ASSEMBLY OF HANDRAIL

BACKGROUND OF THE INVENTION

The present invention relates to an assembly of handrail installed on a veranda, a balucony or the like, and more particularly to the connected construction of horizontal members of a top rail and a botton rail, and upright members of main supporting posts and banisters which are shaped into the respective cylinder of a metal such as aluminium.

Heretofore, cylindrical supporting posts have the top face thereof cut off into a curved surface so as to correspond to the outer peripheral face of a cylindrical top rail whereas the top rail is provided with tapped holes in the face opposite to the top face of the supporting post. The connection between these members is performed in such a manner that a long size of bolt to be set vertically on the footing is inserted in the supporting post, and then the curved top face thereof is brought into the opposite face of the top rail while the tapped upper part of the long size of bolt is screwed into the tapped hole of the top rail.

Howerever the above described connecting means requires a lot of laber and time in processing the top faces of upright members into curved faces according to the outer peripheral face of the top rail. In addition, since the top rail has a construction of one unseparatable body, it can not be observed how many degrees the tapped upper part of a long size of bolt is screwed into the inside of the top rail, whereby the connecting work comes to be troublesome.

OBJECTS OF THE INVENTION

An object of the present invention is to provide an assembly of handrail capble of being connected firmly between horizonal members and upright members without cutting off the end face of the upright member into a curved face.

Another object of the present invention is to provide an assembly of handrail such that it is possible to perform a connecting work with ease and to observe the advanced condition of a screw.

BRIEF DESCRIPTION OF THE INVENTION

Further objects and advantages of the present invention will become apparent from the following description of embodiments with reference to the accomanying drawings.

Figure 14:
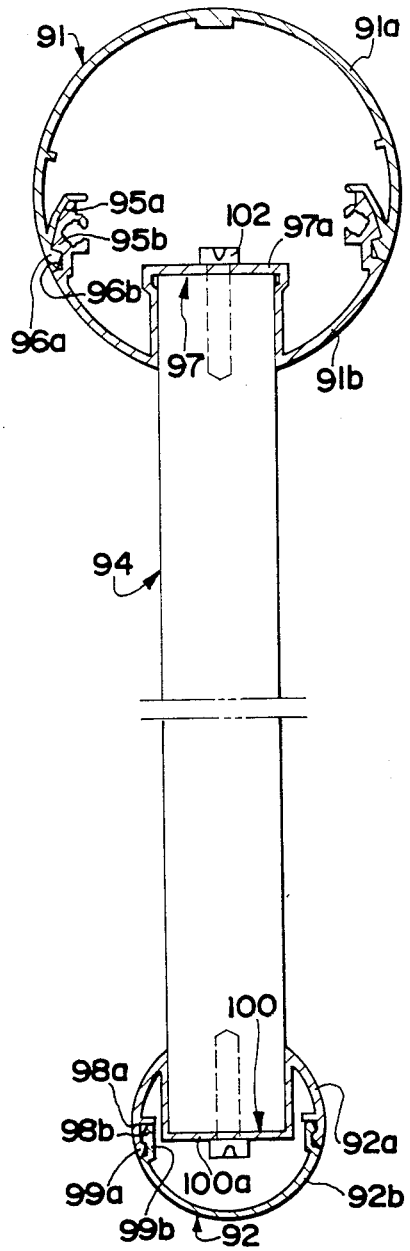
FIG. 14 is an expanded vertical view on line XIV—XIV of FIG. 13.
Figure 15:
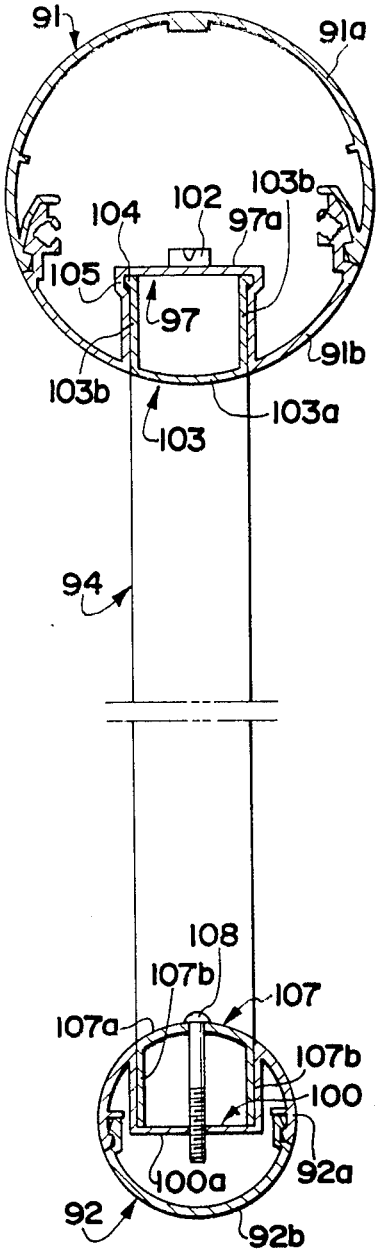
FIG. 15 is an expanded vertical view on line XI—XI of FIG. 13.
Figure 17:
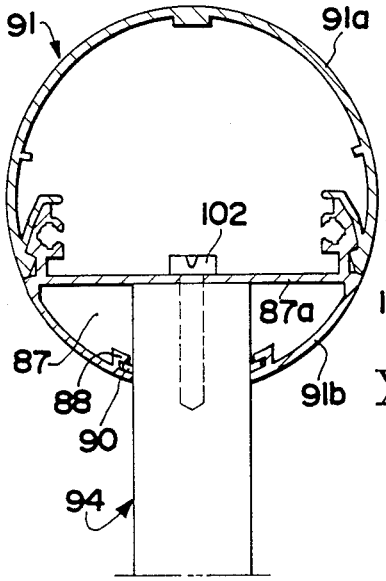
Figure 18:
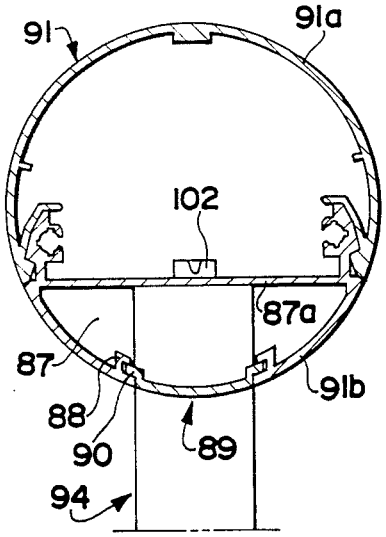

FIGS. 17 and 18, which show a variation of the connected construction of FIG. 14 and 15, are expanded vertical views similar to FIG. 14 and FIG. 15 respectively.

Figure 19:
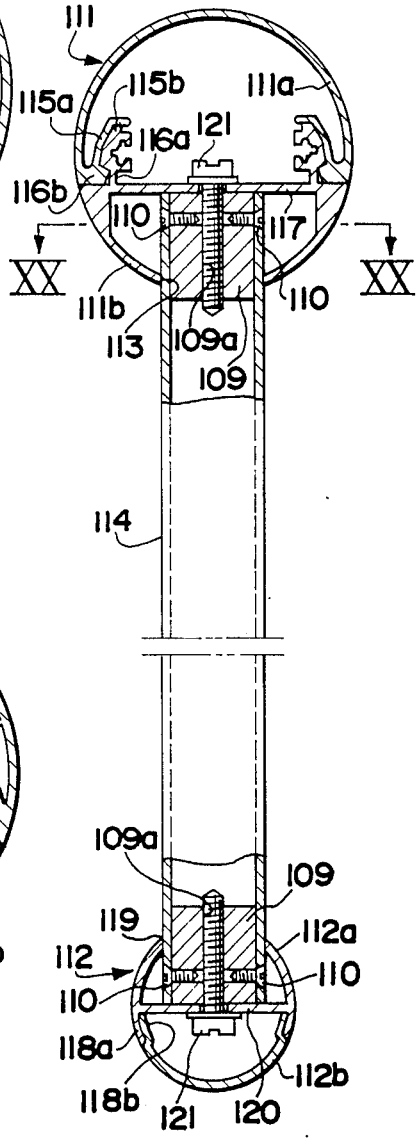

FIG. 19 is a vertical view showing the fifth embodiment

Figure 20:
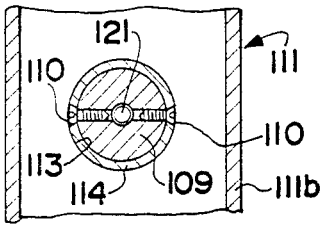

FIG. 20 is a transverse sectional view on line XX—XX of FIG. 19.

Figure 21:
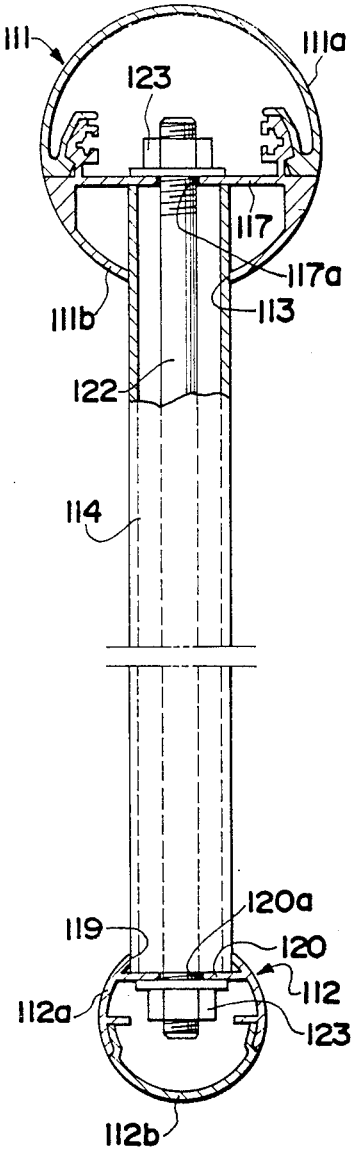

FIG. 21 is a vertical view showing the six embodiment.

DETAILED DESCRIPTION OF THE PREFERRED EMBODIMENTS

Figure 1:
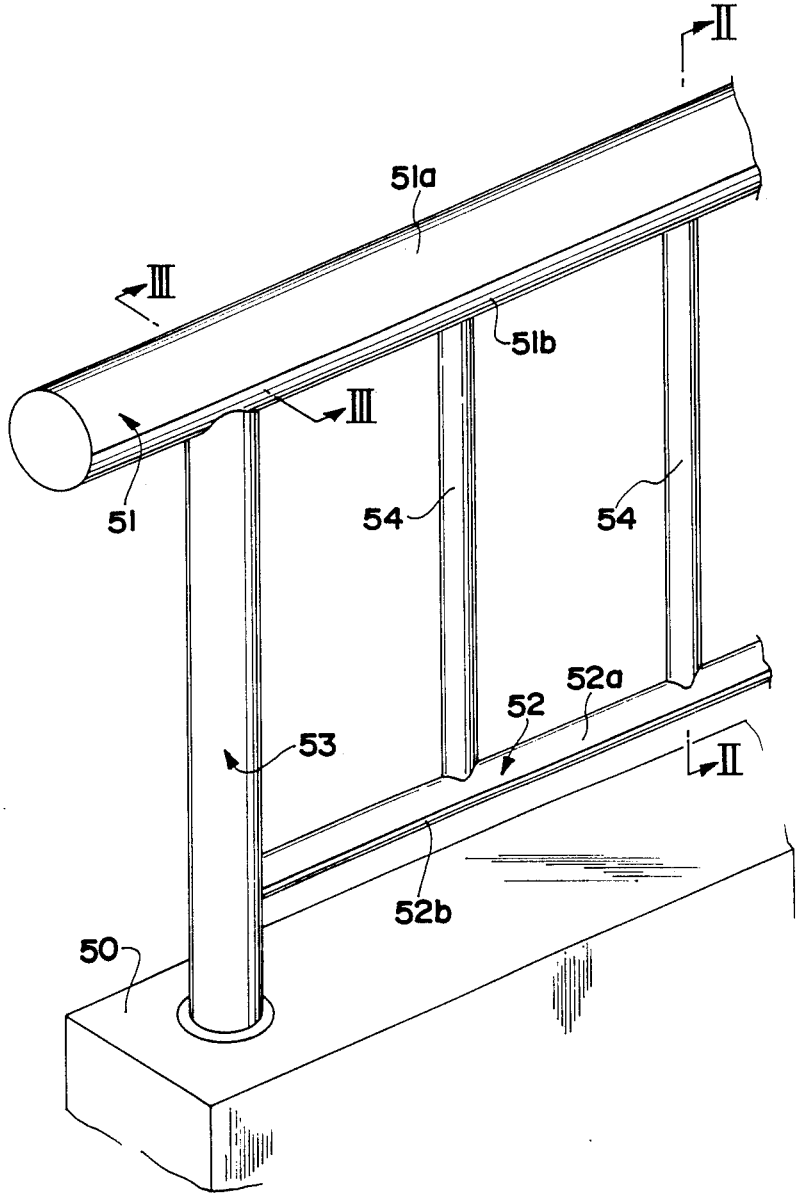
FIG. 1 is a perspective view of an assembly of handrail embodying the present invention.

There is shown the first embodiment of the present invention in FIG. 1–5 inclusive. FIG. 1 shows an assembly of handrail installed on the footing 50 of a veranda. The assembly comprises a pair of top rail 51 and bottom rail, 52, main supporting posts 53--- and bansiters 54---arranged between the supporting post. The top rail 51 and the bottom rail 52 are shaped into a hollow cylindrical form by means of the extrusion of aluminum.

Figure 2:
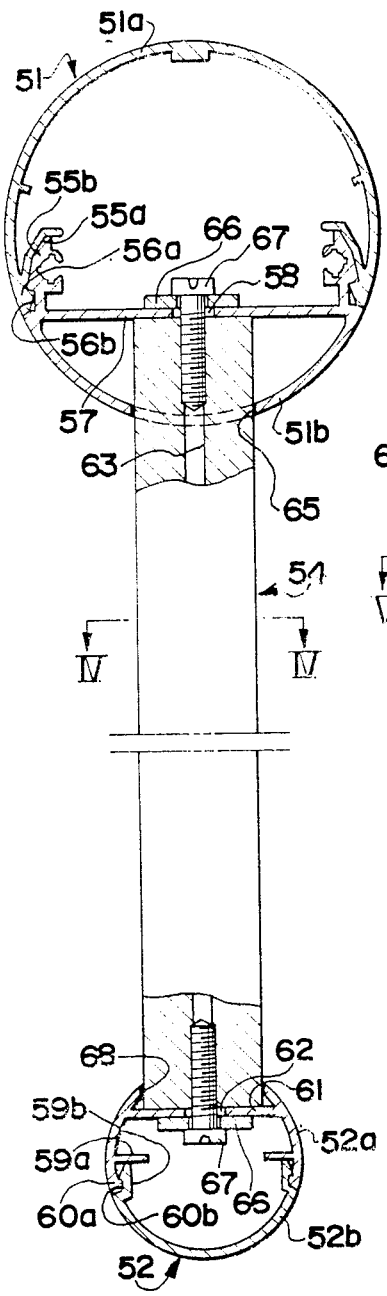
FIG. 2 is an expanded vertical view on line II—II of FIG. 1.

The top rail 51, as apparant from FIG. 2, has a dividable structure consisting of an upper body 51*a* and a lower body 51*b* wherein the upper body 51*a* and the lower body 51*b* are connected detachably to one another in such a manner that the associated depression part 55*a* and the associated prominence part 56*a* of the upper body 51*a* are fitted respectively into the associated prominence part 56*a* and the associated depression part 56*b* of the lower body 51*b* with a pressed condition. In addition, the lower body 51*b* of the top rail 51 has a horizontal supporting wall provided intergrally thereinside aross the total length, which is configured with a slit 58 in the middle of the width thereof also aross the total length.

On the other hand, the bottom rail 52, in the same manner as the above-mentioned top rail 51, has a dividable structure consisting of an upper body 52*a* and a lower body 52*b*, wherein the upper body 52*a* and the lower body 51*b* are connected detachably to one another in such a manner that the associated depression part 59*a* and the associated prominece part 60*a* of the upper body 52*a* are fitted respectively into the associated prominence part 59*b* and the associated depression part 60*b* of the lower body 52*b* with a pressed condition, while the upper body 52*a* of the bottom rail 52 has a horizontal supporting wall 61 provided integrally thereinside across the total length, which is configureed with a slit 62 of the total length in the middle of the width thereof.

Figure 4:
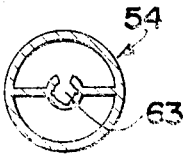
FIG. 4 is a transverse sectional view on line IV—IV of FIG. 2.
Figure 5:
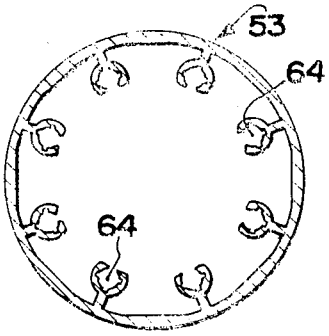
FIG. 5 is a transverse sectional view on line V—V of FIG. 3.
Figure 6:
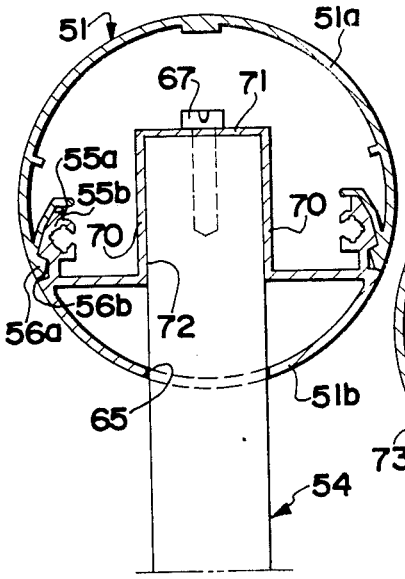
FIG. 6 is an expanded vertical view of the second embodiment, similar to FIG. 2.

The main supporting post 53 and the banister 54 also are shaped into a hollow cylindrical form by the extrusion of aluminum. The banister.54 has a,byHoblong hole for a self tapping screw provided integrally axially in the center thereof across the total length as shown in FIG. 4, whereas the supporting post 53 has several holes provided axially at fixed intervals intergrally in the inner round wall thereof across the total length as shown in FIG. 5

FIG. 2 shows the connected construction between the bansister 54 and both of the top rail 51 and bottom rail 52. The lower body 51*b* of the top rail 51 has circular openings 65--- configured at the middle of the width and at every longitudinal given positions,which have a diameter identical with or somewhat wider than the outside diameter of the banister 54. Thereby the circular opening 65 allows the upper end part of the banister 54 to put into the lower body 51*b*. The connection between the top rail 51 and the banister 54 is performed at right angle through the steps of bringing the top face of te banister 54 into contact with the underside of the horizontal supporting wall 57, and then of tightening a self tapping screw 67 through the slit 58 located over the banisher 54 by way of a washer 66 into the hole 63.

On the other hand, the upper body 52*a* of the bottom rail 52 has circular openings 68--- provided in the same way as the above-mentioned lower body 51*b* of the top rail 51, whereby the circular opening 68 allowes the the lower end part of the banister 54 to put into the upper body 52*a* of the bottom rail 52. The connection between the bottom rail 52 and the banister 54 is performed through the steps of bringing the bottom face of the banister into contact with the upperside of the horizontal supporting wall 61, and then of tightening a self tapping screw 67 through the slit 58 by way of a washer 66 into the hole 63.

As regards the upper body 51*a* of the top rail 51 and the lower body 52*b* of the bottom rail 52, they are removed during the connecting work, and are fitted on the respective another bodies 51*b*, 52*b* after finishing the connecting work.

On making the aforesaid openings 65, for example, in the lower body 51*b* of the top rail 51, a punch (not shown) is put in lower body 51*b*, that is,the operating top part of the punch is stuck out of the slit 58 of the horizontal supporting wall 57, whereas a receiving plate is arranged on the underside of the lower body 51*b*. In such a condition, the downward movement of the punch bring an opening to the lower body 51*b*. Then the punch is moved further to a next punching position while the shank of the punch is slided along the slit 58. Also the bottom rail 52 has openings 68 formed in the same manner as the top rail 51.

Figure 3:
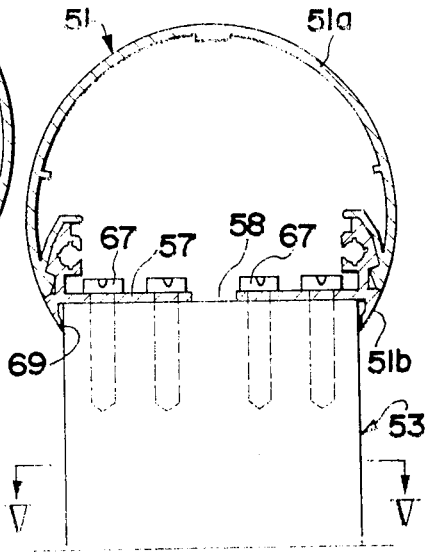
FIG. 3 is an expanded vertical view on line III—III of FIG. 1.

FIG. 3 shows the connected construction of the top rail 51 and the main supporting post 53. For the purpose of connecting these members, the lower body 51*b* of the top rail 51 has circular openings 69 provided at required positions, which have a diameter identical with or somewhat wider than the outside diameter of the supporting post 53. Thereby the circular opening 65 allows the upper end of the supporting post 53 to put into the lower body 51*b*. Then the top face of the supporting post 54 is brought into contact with the underside of the horizontal supporting wall and 57, and then self tapping screws 67 are tightened into the holes of the supporting post 53 through holes (not shown) provided in the horizontal supporting wall 57.

Instead of the above described slit 58, the horizontal supporting wall 57, for example, of the lower body 51*b* of the top rail 57 may be provided with holes having such a size that the self tapping screws 67 can pass through. In the case of providing the slit 58 in the horizontal supporting wall 57 across the total length, the punch is put in the lower body 51*b* in a manner slidable along the slit 58, whereby the piercing work of the lower body 51*b* can be performed efficiently.

The above-mentioned connected construction according to the present invention is provided with the openings 65 in order that the end parts of the upright member 51, 52 is put into the upper or lower body. The piercing work of the aforesaid openings is performed more easily and simply in contrast with the upright member of the prior art which has the end parts cut off curvedly. In addition, the upright member 51, 52 have the top face brought into contact with the horizontal supporting wall 57 while having the end part supported by the opening, whereby the support of the upright member is stabilized much more to the rails.

There are shown the second embodiment and its variations of the present invention in FIG. 6–9 inclusive, wherein the same structual parts as the ones in the above-mentioned first embodiment are indicated by the same numerals. In the connected construction of the top rail 51 and the banister 54 shown in FIG. 6, the lower body 51*b* of the top rail 51 is provided thereinside across the total length integrally with a plate of supporting wall conisting of a pair of the facing vertical supporting walls 70, 70 shaped into a sectional L-like form and a horizontal supporting wall 71 which is configured integrally with the upper ends of the aforesaid vertical supporting walls.

The connection between the lower body 51*b* of the top rail 51 and the upper end part of the banister 54 is performed through the steps of the upper end part being put through the opening 65 into the gap 72, and then of the top face of the banisher 54 being brought into contact with the underside of the horizontal supporting wall 71 while a self tapping screw 67 is tightened into a hole (not shown) of the banister 54.

Figure 7:
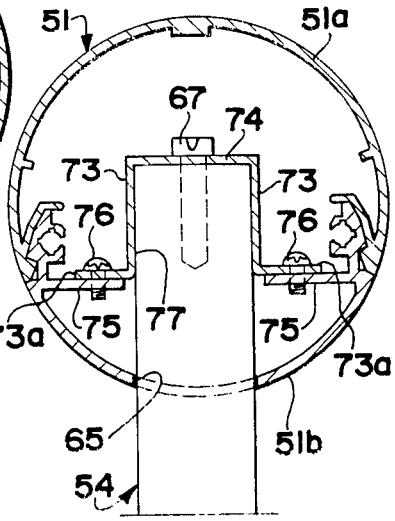
FIGS. 7, 8 and 9 are expanded vertical views showing the variations of the connected construction shown in FIG. 6, similar to FIG. 6.

In the connected construction of the top rail 51 and the banister 54 shown in FIG. 7, a plate of supporting wall consists of a pair of vertical supporting walls 73 ---opposite to each other and a horizontal supporting wall 14. Although the supporting wall has the same structure as the one described above in FIG. 6 , it is formed independently of the lower body 51*b*. The supporting wall has the lower edges 73*a* of the vertical supporting walls 73 fixd by machine screws 76 on a pair of mounting walls 75 which are configured integrally with the lower body 51*b* across the total length.

The connection between the lower body 51*b* the top rail 51 and the upper end part of the banister 54 is performed in the same manner as described above in FIG. 6.

Figure 8:
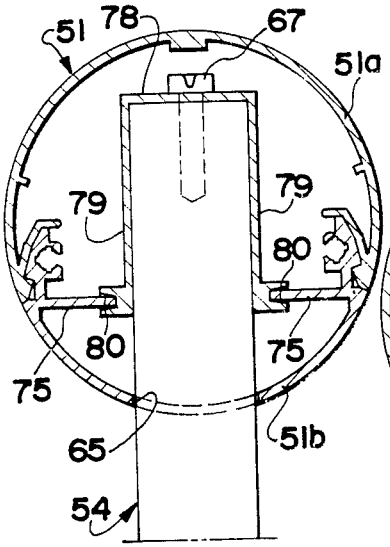

In the connected construction shown in FIG. 8, a plate of supporting wall consists of a pair of vertical supporting walls 79--- and a horizontal supporting wall 78. The pair of vertical supporting walls 79--- have the respective lower end parts provided with outwards opened grooves 80---. Into the respective grooves is fitted the end part of the mounting wall 75--- rigidly interconnected with the lower body 51*b*. The connection between the upper end part of the banister 54 and the horizontal supporting wall 78 is performed in the same manner as described above in FIG. 6.

Figure 9:
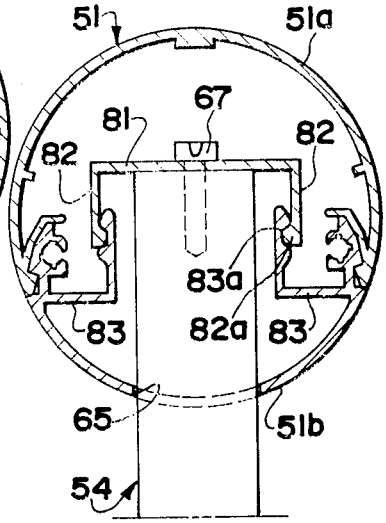

In the connected construction shown in FIG. 9, a plate of supporting wall consists of a pair of vertical supporting walls 82--- and a horizontal supporting wall 81. The pair of vertical supporting walls 82 have the respective lower end parts provided with inward and longitudinal projections 82*a*----. These projections 82*a* are fitted into depressions 83*a* configured in the mounting walls 83---. The connection between the upper end part of the banister 54 and the horizontal supporting wall 81 is performed in the above described manner.

Figure 10:
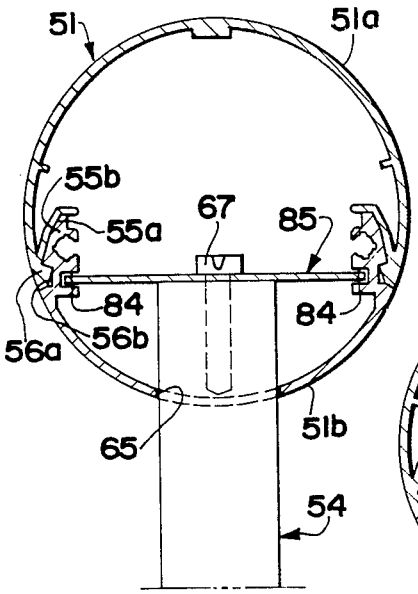
FIG. 10 is an expanded vertical view of the third embodiment.
Figure 11:
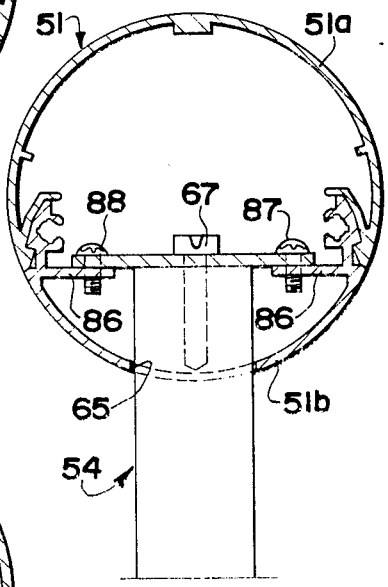
FIGS. 11 and 12 are expanded vertical views showing the variations of the third embodiment.
Figure 12:
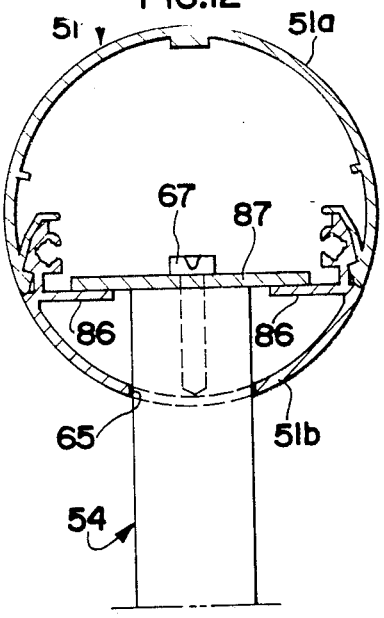
Figure 13:
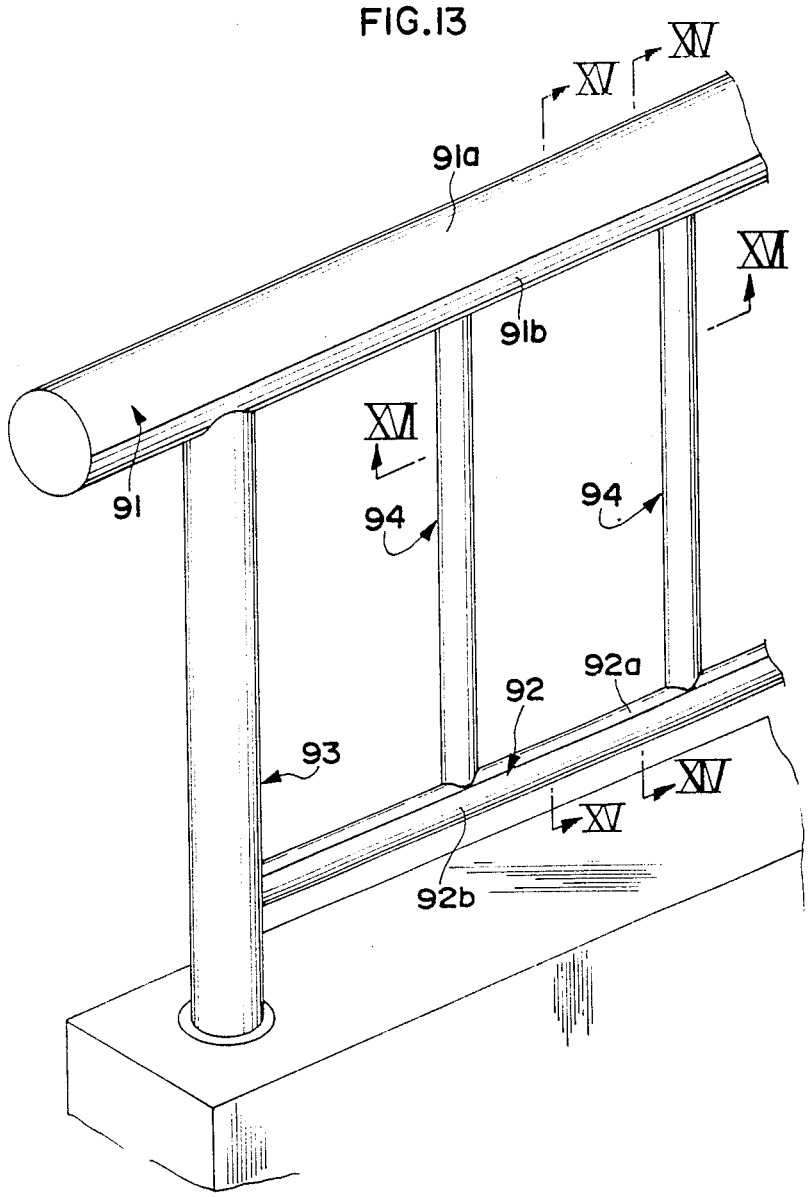
FIG. 13 is a perspective view of the fouth embodiment of the present invention.

There are the third embodiment and its variations of the present invention in FIG. 10–12 inclusive, wherein the same structual parts as the ones in the first embodiment are indicated by the same numerals.

In the connected construction of the top rail 51 and the banister 54 shown in FIG. 10, the lower body 51*b* of the top rail 51 is provided in the inside and upper part with grooves 84--- opposite to one another across the total length. Into the grooves 84--- is fitted the side end of anoblong plate of horizontal supporting wall 85 which is arranged in the total length of the top rail 1.

The connection between the lower body 51*b* of the top rail 51 and the upper end part of the banister 54 is performed through the steps of the upper end part of the banister 54 being put through the opening 65 into the lower body 51*b*, and then of the top face of the banister 54 being brought into contact with the underside of the horizontal supporting wall 87 while a self tapping screw 67 is tightened into a hole (not shown) of the banister 54.

In the connected construction shown in FIG. 11, the lower body 51*b* of the top rail 51 is provided across the total length with mounting walls 86--- projecting from the respective insides of the top rail 51. On the respective end parts of the mounting walls 86--- is laid the side end parts of a plate of horizontal supporting wall 87 and then is fixed by screws 88---. The connection of the banister 54 and the plate of the horizontal supporting wall 87 is performed through the step of the upper end part of the banister 54 being put through the opening 65 into the lower body 51*b*, and then of the top face of the banister 54 being brought into contact with the underside of the horizontal supporting wall plate 87 while a self tapping screw 67 is tightened into a hole (not shown) of the banister 54.

The connected construction shown in FIG. 12 is the same as the one in FIG. 11. However the horizontal supporting wall plate 87 has the sides thereof fixed on the mounting wall 86 of the lower body 51*b* with an adhesive substance (not shown).

There are shown the fourth embodiment of the present invention in FIG. 13–16 inclusive, wherein the numeral 91 indicates a top rail, and the numerals 912, 93 and 94 indicate respectively a bottom rail, a main supporting post and banisters.

The top rail 91, as apparant from FIG. 14., has a dividable structure consisting of an upper body 91*a* and a lower body 91*b*, wherein the upper body 51*a* and the lower body 51*b* are connected detachably to one another in such a manner that the associated depression part 95*a* and the associated prominence part 96*a* of the upper body 91*a* are fitted respectively into the associated prominence part 95*b* and the associated depression part 96*b* of the lower body 91*b* with a pressed condition. In addition, the lower body 91*b* is provided in the middle across the total length with a recess 97 which is shaped into a substancially rectanglar form in cross section.

On the other hand, the bottom rail 92, in the same manner as the above-mentioned top rail 91, has a dividable structure consisting of an upper body 92*a* and a lower body 92*b*, wherein the upper body 92*a* and the lower body 92*b* are connected detachably to one another in such a manner that the associated depression part 98*a* and the associated prominence 99*a* of the upper body 92*a* are fitted respectively into the associated prominence part 98*b* and the associated depression 99*b* of the lower body 92*b* with a pressed condition. The upper body 92*a* also is provided in the middle across the total length with a recess 100 substancially similar to the above-mentioned recess 97 of the top rail 91.

The aforesaid recesses 97, 100 have such a width that the banister 94 can be slided when put into the recess, i.e., a width of the substancially same size as the diameter of the banister 94.

The connection between the upper end part of the banister 94 and the lower body 91*b* of the top rail 91, from which the upper body 91*a* is removed beforehand, is performed through the steps of the upper end part of the banister 94 being put into the recess 97 of the lower body 91*b*, and then of the top face of the banister 94 being brought into contact with the inner wall 97*a* of the recess 97 while a tapping screw 102 is tightened into a hole (not shown) which is configured in the inner wall 97*a* and the banister 94.

In addition, in the recess 97 between two banisters next to one another, a covering member 103 is fitted over the recess 97 so as to cover the opening of the recess 97. As apparant from FIG. 15 and 16 in particular, the covering member 103, which is made of the material of aluminum or synthetic resin, comprises an outer wall part 103*a* arcuate in cross section and both side wall parts 103*b*--- extending from the both side ends of the outer wall part. The covering member 103 is fixed in such a manner that outward projections 104 from the respective edges of the both side walls are fitted into depressions 105 configured in the deep parts of the recess 97 as shown in FIG. 15.

Figure 16:
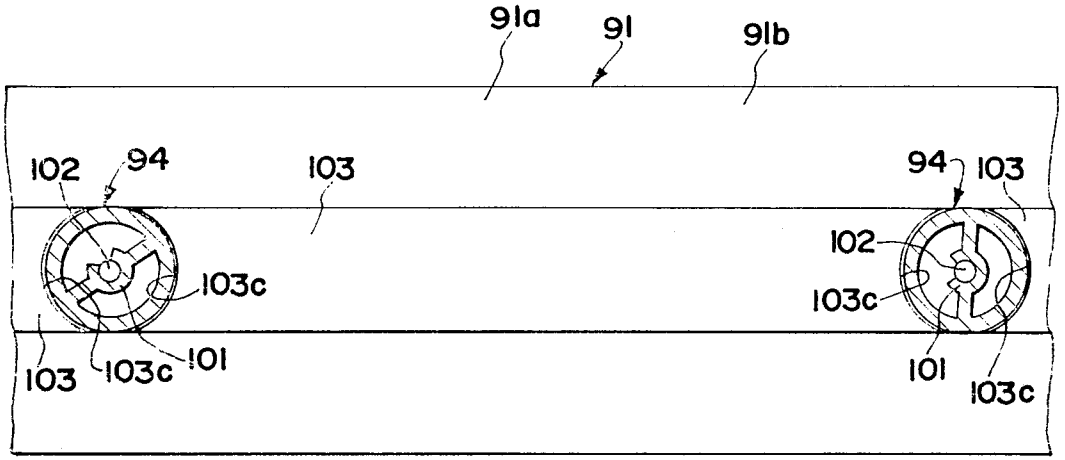
FIG. 16 is an expanded transverse sectional view on line XVI—XVI of FIG. 13.

The longitudinal end faces 103c of the covering member 103 are cut off into a substancially semi-circular form so as to be fit with the outer peripheral face of the banister 94 as shown in FIG. 16. The aforesaid arcurate outer wall part of the covering member 103 is curved continuously in the same manner as the outside acurate surface of the lower body 91*b*.

On the other hand, the connection between the lower end part of the banister 94 and the upper body 92*a* of the bottom rail 92 is performed through the steps of the lower end part of the banister 94 is put into the recess 100 of the upper body 92*a*, and then of the top face of the banister 94 being brought into contact with the inner wall 100*a* of the recess 100 while a tapping screw 102 is tightened into a hole (not shown) which is configured in the inner wall 100*a* and the banister 94. Also in the recess 100 between two banisters next to each other, as described above concerning the top rail 91, a covering member 107 is fitted over the opening of the recess 100. The covering member 107 also comprises an outer wall part 107*a* arcuate in cross section and the both side wall parts 107*b*--- extending from the side ends of the outer wall part. From over the outer wall part 107*a*, a screw 108 is tightened down in the inner wall 100*a* of the recess 100 whereby the covering member 107 is fastened.

In FIG. 17 and 18, there is shown a variation of the fourth embodiment described above with FIG. 13–16, wherein the lower body 91*b* of the top rail 91 is provided across the total length with a recess 87 opened downwards while a pair of longitudinal depressions are provided in the parts next to the opening of the lower body 91*b*. The connection between the upper end part of the banister 94 and the lower body 91*b* of the top rail 91 is performed through the steps of the upper end part of the banister 94 being put into the recess 87 of the lower body 91*b*, and then of the top face of the banister 94 being brought into contact with the inner wall 87*a* of the recess 87 while a tapping screw 102 is tightened into a hole (not shown). In addition, in the recess 102 between two banisters next to each other, a covering member 89 arcuate in cross section is fitted over the opening prominences 90 configured in the both side ends of the covering member 89.

In FIG. 19 and 20, there is shown the fifth embodiment of the present invention, wherein into the upper and lower end parts of a hollow cylindrical banister 114 is inserted respectively a short size of solid cylindrical block which has an axial tapped hole in the center, and then is fixed by screws 110 to the banister 114.

A top rail 111 has a dividable structure consisting of an upper body 111*a* and a lower body 111*b*, wherein the upper body 111*a* and the lower body 111*b* are connected detachably to one another in such a manner that the associated depression part 115*a* and the associated prominence part 116*b* of the upper body 111*a* are fitted respectively into the associated prominence part 115*b* and the associated depression part 116*a* of the lower body 111*b* in a pressed condition. The lower body 111*b* has circular openings 113 configured in the lower part so as to be entered by the upper end part of the banister 114, and have a horizontal supporting wall 117 provided inside rigidly interconnectedly therewith.

On the other hand, a bottom rail 112, similar to the above-mentioned top rail 111, has a dividable structure consisting of an upper body 112*a* and a lower body 112*b*, wherein the upper body 112*a* and the lower body 112*b* are connected detachably to one another in such a manner that the associated parts 118 of the lower body 112*b* are fitted onto the inside face of the lower end part of the upper body 112*a* by outwards pressing force. The upper body 112*a* has circular openings 119 configured in the upper part and have a horizontal supporting wall 120 provided inside rigidly interconnectedly therewith.

The respective connection between the banister 114 and the the lower body 116 of the top rail 111, and between the banister 114 and the upper body 112*a* of the bottom rail 112 is performed through the steps of putting the end parts of the banister 114 into the respective openings 113, 119, and then of bringing the respective top faces of the banister 114 into contact with the respective horizontal supporting wall 117, 120 while tightening bolts 121 into the tapped holes 109*a* of the blocks 109 through the supporting wall 117, 120.

There are shown the sixth embodiment of the present invention in FIG. 21, where the same structual parts as the ones shown in FIG. 19 are indicated by the same numerals.

In the connected construction shown in FIG. 21, a long size of bolt 122 is inserted into a hollow cylindrical banister 114 while is projected from holes 117*a*, 120*a* of the respective horizontal supporting walls 117, 120, and then has nuts 123 screwed on the opposite end parts, whereby the connection between the banister 114 and the respective bodies 111*b*, 112*a* is performed. The upper body 111*a* of the top rail 111 and the lower body 112*a* of the bottom rail 112 are removed respectively from the lower body 111*b* and the upper body 112*b* before the connecting work, and then are fitted respectively to another body 111*b*, 112*b* after the connecting work.

According to the above described embodiment, it is unnecessary to provide a hole for a self tapping screw and a block-like filling in the banister 114, whereby it is possible to simplify the construction of the banister. In addition, the connection between the banister 114 and the top and bottom rails 111, 112 is performed simply and promptly by the use of nut 123 for a long size of bolt 122.

What is claimed is:

1. An assembly of handrail comprising horizontal members and vertical members, characterized in that said horizontal members have a hollow cylindrical form consisting of an upper body and a lower body arcuate in cross section which are connected detachably by engaging means configured in the respective bodies, either said upper body or said lower body being provided with openings which correspond to the cross section of the vertical member, while provided inside with a horizontal supporting wall for supporting the end part of the vertical member to be put through the opening in the horizontal member, said horizontal supporting wall having a slit formed longitudinally in the middle of the width and throughout the total length of the horizontal member, wherein the vertical member is connected to the horizontal member in such a manner that a screw member is tightened through said horizontal supporting wall into the vertical member.

2. An assembly of handrail as defined in claim 1, wherein said engaging means consist of an associated depression configured in the both side ends of either of said bodies and an associated prominence configured in the both side ends of the other body opposite to said both side ends of the one body so as to engage with said associated depression, whereby the one body is connected to the other body in a pressed condition.

3. An assembly of handrail as defined in claim 1, wherein said horizontal supporting wall is configured integrally with either of said bodies across the total length whereas said vertical member is provided inside across the total length with one or more longitudinal hole for a self tapping screw, whereby a self tapping screw is tightened through the slit of the horizontal supporting wall into said hole while the end part of the vertical member is brought into contact with the horizontal supporting wall, so that the vertical member and the horizontal member are connected to one another.

4. An assembly of handrail as defined in claim 1, wherein said vertical member has a hollow cylindrical form, of which both end parts are fitted inside with blocks having a longitudinal tapped hole, and the end part of the vertical member put in said opening being brought into contact with the horizontal supporting wall while a bolt is tightened through the slit of the horizontal supporting wall into the hole of said block.

5. An assembly of handrail comprising horizontal members and vertical members, characterized in that said horizontal members have a hollow cylindrical form consisting of an upper body and a lower body arcuate in cross section are connected detachably by engaging means configured in the respective bodies, either said upper body or said lower body being provided with openings which correspond to the cross section of the vertical member while provided inside with a horizontal supporting wall for supporting the end part of the vertical member to be put through the opening in the horizontal member, wherein a long size of bolt used as a screw member is inserted into the vertical member across the total length while is passed throught the horizontal supporting wall, and is projected outwards from the end parts of the vertical member, and said projected end parts of the long size of bolt being fitted with nuts whereby the connectin between the horizontal and verticla members is performed.

* * * * *